US006759123B2

(12) United States Patent
Jeong et al.

(10) Patent No.: US 6,759,123 B2
(45) Date of Patent: Jul. 6, 2004

(54) HIGH STRENGTH AND LOW SHRINKAGE POLYESTER YARN AND PROCESS FOR ITS PREPARATION

(75) Inventors: Yi-woon Jeong, Gwacheon-si (KR); Min-jae Yoo, Seoul (KR); Dong-seok Shim, Seoul (KR)

(73) Assignee: Hyosung Corporation, Seoul (KR)

( * ) Notice: Subject to any disclaimer, the term of this patent is extended or adjusted under 35 U.S.C. 154(b) by 0 days.

(21) Appl. No.: 10/371,354

(22) Filed: Feb. 20, 2003

(65) Prior Publication Data

US 2004/0013874 A1 Jan. 22, 2004

(30) Foreign Application Priority Data

Jul. 20, 2002 (KR) ..... 10-2002-0042774

(51) Int. Cl.[7] ..... D01F 6/00
(52) U.S. Cl. ..... 428/364; 428/395
(58) Field of Search ..... 428/364, 395

(56) References Cited

U.S. PATENT DOCUMENTS 4,690,866 A * 9/1987 Kumakawa et al. ..... 428/364
5,277,858 A 1/1994 Neal ..... 264/210.8
5,472,781 A * 12/1995 Kim et al. ..... 428/364
5,891,567 A * 4/1999 Kim et al. ..... 428/364
RE36,698 E * 5/2000 Kim et al. ..... 428/364
6,620,502 B1 * 9/2003 Fujimoto et al. ..... 428/357

FOREIGN PATENT DOCUMENTS

| | | |
|---|---|---|
| JP | 46-6459 | 12/1971 |
| KR | 1995-0000717 | 1/1995 |
| KR | 1998-028329 | 7/1998 |
| KR | 10-0193940 | 6/1999 |

* cited by examiner

*Primary Examiner*—N. Edwards
(74) *Attorney, Agent, or Firm*—Michael J. Striker

(57) ABSTRACT

Disclosed is a high strength and low shrinkage polyester yarn, which has tenacity of 7.4 g/d or higher, elongation at break of 19 to 26%, shrinkage percentage of 2% or lower, and respective thermal-stress peaks of $3\times10^{-2}$ to $7.5\times10^{-2}$ g/d and $8.0\times10^{-2}$ to $10.5\times10^{-2}$ g/d at temperature ranges of 100 to 140° C. and 230 to 240° C., and process for its preparation. The high strength and low shrinkage polyester yarn is advantageous in that it has desirable resistance to external load and excellent dimensional stability, and is very useful as an industrial yarn with uniform shrinkage and excellent dimensional stability during a post-process for application to tarpaulin and truck covers.

3 Claims, 3 Drawing Sheets

HIGH STRENGTH AND LOW SHRINKAGE POLYESTER YARN AND PROCESS FOR ITS PREPARATION

BACKGROUND OF THE INVENTION

1. Field of the Invention

The present invention relates, in general, to a high strength and low shrinkage polyester yarn and method of preparing the same and in particular, to a high strength and low shrinkage polyester yarn, which has desirable resistance to external load and excellent dimensional stability, and is useful as an industrial yarn with uniform shrinkage and excellent dimensional stability during a post-process for application to tarpaulins and truck covers, and a process for its preparation.

2. Description of the Prior Art

Having excellent physical and chemical properties, industrial uses for polyester yarn continuously increase. Particularly, high strength polyester yarn is used as a base textile of coated textiles such as tarpaulins and truck covers. However, because tarpaulins and truck covers are prepared by coating the base textile with PVC at 180 to 230° C., the high strength polyester yarn is nonuniformly shrunk due to its poor shrinkage property during a coating process, thus lacking dimensional stability. Furthermore, the high strength polyester yarn shrinks considerably during a post-process to degrade the quality of the coated textile. Accordingly, there remains a need to develop a high strength and low shrinkage polyester yarn.

One of processes of preparing a low shrinkage polyester yarn is a warp drawing process in which undrawn yarn (UDY) or partially oriented yarn (POY) wound after a spinning process is drawn, heat-treated, and relaxed using separate devices. For example, Korean Patent Publication No. 1995-0000717 discloses the warp drawing process, in which undrawn yarn or partially oriented yarn is drawn and heat-treated to prepare a polyester yarn with tenacity of 8.0 g/d or higher, dry-heat shrinking percentage (190° C.) less than 2%, and elongation at break of 15 to 25%. However, the warp drawing process has disadvantages of high equipment cost, reduced productivity, and increased production costs because of the separate drawing device.

An alternative process for preparing the low shrinkage polyester yarn is a direct spinning drawing process disclosed in Japanese Patent Laid-open Publication No. Sho. 46-6459, in which spinning, drawing, and relaxing steps are continuously performed. Korean Patent No. 0193940 proposes a method of preparing a high elongation and low shrinkage polyester yarn having a total draw ratio of 5.0 to 6.5, relaxation ratio of 10 to 15%, and fineness of 7 to 15 deniers by the direct spinning drawing process. However, the direct spinning drawing process is disadvantageous in that dry-heat shrinkage percentage is a high 3.3% when relaxation ratio is 12.7% even though residence time of the polyester yarn on a roller is increased by slowing a spinning speed to 600 m/min.

As described above, in the case of preparing the low shrinkage polyester yarn by the direct spinning drawing process, if the total draw ratio is increased to obtain a high strength yarn, a degree of orientation in the yarn is increased, thus undesirably increasing its shrinkage ratio.

Additionally, if relaxation percentage is increased so as to reduce shrinkage, trembling of threads on a godet roller is undesirably increased to cause yarn breakage, thereby reducing workability.

Meanwhile, U.S. Pat. No. 5,277,858 suggests a method of preparing a low shrinkage polyester yarn having tenacity of 7.2 g/d or higher, shrinkage percentage less than 2.0% at 177° C., and shrinkage percentage less than 4.5% at 200° C. by the spinning-drawing continuous process. But this method is disadvantageous in that a separate heating device is needed, which is used in a heating roller box. Furthermore, Korean Patent Laid-open Publication No. 1998-028329 discloses a method of preparing a low shrinkage yarn, in which a heating and a cooling device, and a steam supplying device are additionally set between godet rollers. However, a large space as well as additional devices such as the heating and cooling device and the steam supplying device are needed so as to commercialize this method, thus reducing economic efficiency.

SUMMARY OF THE INVENTION

Therefore, the present invention has been made keeping in mind the above disadvantages occurring in the prior art, and an object of the present invention is to provide a high strength and low shrinkage polyester yarn, which has desirable resistance to external load and is useful as an industrial yarn with uniform shrinkage and excellent dimensional stability during a post-process for application to tarpaulins and truck covers.

It is another object of the present invention to provide a method of preparing the high strength and low shrinkage polyester yarn.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
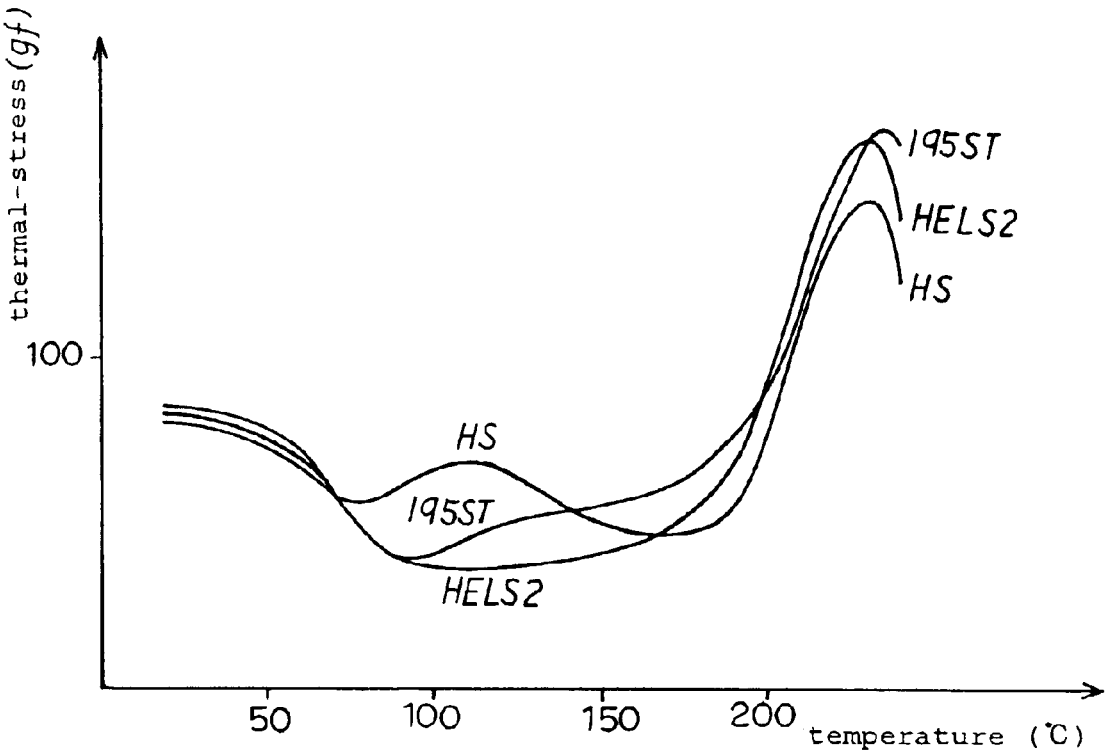
FIG. 1 is a graph showing heat stress as a function of temperature for a high strength and low shrinkage polyester yarn by example 1 of the present invention, and for two conventional types of polyester yarns.

The present invention provides a high strength and low shrinkage polyester yarn, which has tenacity of 7.4 g/d or higher, elongation at break of 19 to 26%, shrinkage percentage of 2% or lower, and respective thermal-stress peaks of $3\times10^{-2}$ to $7.5\times10^{-2}$ g/d and $8.0\times10^{-2}$ to $10.5\times10^{-2}$ g/d at temperature ranges of 100 to 140° C. and 230 to 240° C.

The high strength and low shrinkage polyester yarn is characterized in that a ratio of a thermal-stress peak at a temperature range of 230 to 240° C. to a thermal-stress peak at a temperature range of 100 to 140° C. is 1.3 to 3.0, and a shrinkage force of the polyester yarn within the first 5 sec after the start of shrinkage is $4.5\times10^{-2}$ to $6.5\times10^{-2}$ cN/d and the shrinkage force of the polyester yarn thereafter is $1.5\times10^{-2}$ to $3.5\times10^{-2}$ cN/d.

Furthermore, the present invention provides a method of preparing a high strength and low shrinkage polyester yarn by the a direct spinning drawing process, comprising (a) spinning a melted polyester polymer at a speed of 383 to 490 m/min, (b) drawing a spun polyester yarn in a total draw ratio of 5 to 6.4, and (c) relaxing a drawn polyester yarn at 230 to 250° C. by a godet roller in relaxation ratio of 9 to 13%.

The relaxation is performed through a first relaxing step and a second relaxation step, and a relaxation distribution ratio of the first relaxation step to the second relaxation step is 9:1 to 1:9.

A more detailed description of the high strength and low shrinkage polyester yarn and the method of preparing the same will be given, below.

The high strength and low shrinkage polyester yarn of the present invention is prepared by the a direct spinning drawing process.

In detail, a polyester polymer is melted and then spun at a speed of 383 to 490 m/min. In consideration of spinning workability and low shrinkage property, it is preferable to use the polyester polymer with an intrinsic viscosity of 0.74 to 0.95. After 0.4% polyester solution is prepared using a mixed solvent, in which phenol is mixed with 1,1,2,2-tetrachloroethane in a mixing ratio of 6:4, to measure a passing time ratio of the polyester solution to the mixed solvent through a standard capillary by use of an Auto Visc II viscometer manufactured by Canon Co., the intrinsic viscosity (IV) of the polyester polymer is calculated according to a following Bill-Meyer Equation:

$$IV = \frac{RV - 1}{4C} + \frac{3\ln(RV)}{4C}$$

(wherein, C is a concentration of the polyester polymer in the polyester solution (g/100 ml))

An undrawn polyester yarn is then drawn at a total draw ratio of 5 to 6.4. When the draw ratio is less than 5, orientation of the yarn is poor, thus not obtaining desired strength. On the other hand, when the draw ratio is more than 6.4, the yarn is over-drawn to cause a single yarn-breakage, thereby reducing workability or causing a full yarn breakage. The drawn polyester yarn is relaxed in relaxation ratio of 9 to 13% at 230 to 250° C. At this time, the polyester yarn is heat-treated by a godet roller. When the relaxation ratio is less than 9%, it is difficult to obtain the desirable low shrinkage polyester yarn, and when the relaxation ratio is more than 13%, trembling of threads on the godet roller is undesirably increased, thereby reducing workability.

A relaxation process may be performed through a single step, but it is preferable that the relaxation process is performed through two steps, i.e. a first relaxation step and a second relaxation step. At this time, a relaxation distribution ratio of the first relaxation step to the second relaxation step is preferably 9:1 to 1:9. When the polyester yarn is relaxed through two steps, trembling of threads on the godet roller is reduced and heat-treatment efficiency is improved due to sufficient residence time or the polyester yarn on the godet roller, so an actual relaxation ratio reaches an available relaxation ratio to improve shrinkage property of the polyester yarn. When a temperature of the godet roller is less than 230° C., relaxation efficiency is reduced because of insufficient heat-treatment efficiency, thus the polyester yarn is poor in terms of low shrinkage property. On the other hand, when the temperature is more than 250° C., tenacity of the polyester yarn is reduced due to thermal decomposition of the yarn. The relaxed polyester yarn may be wound at a speed of 2000 m/min or faster.

According to the method of preparing the high strength and low shrinkage polyester yarn of the present invention, a separate cooling device and heating device are not necessary because the roller emits heat, and the polyester yarn with excellent physical properties including tenacity of 7.4 g/d or higher, elongation at break of 19 to 26%, and shrinkage percentage of 2% or lower is obtained. Conventionally, these desirable physical property values could be obtained from a warp drawing process, that is to say, a spinning-drawing two step process which has higher heat-treatment efficiency than a spinning-drawing continuous process.

The high strength and low shrinkage polyester yarn of the present invention has higher crystallinity and lower amorphous orientation than a conventional high strength and low shrinkage yarn prepared by the continuous process, in a view of microstructure. Furthermore, the polyester yarn by the present invention is characterized in that it has lower crystallinity, less tie molecules, and more amorphous regions with low orientation than the conventional high strength and low shrinkage yarn prepared by the warp drawing process. The reason for this is that crystallization of an amorphous regions with high orientation is induced under conditions of desirable spinning speed, total draw ratio, relaxation ratio, and relaxation temperature, so amorphous regions dwindle away and, if existing, the amorphous region has a low degree of orientation due to high relaxation efficiency. That is to say, an amount and a degree of orientation of oriented amorphous regions which are shrunk to a high randomness state are reduced, thereby improving the low shrinkage property of the polyester yarn.

Meanwhile, the high strength and low shrinkage polyester yarn by the present invention has several unique thermal characteristics as follows. That is to say, it has two thermal-stress peaks of $3\times10^{-2}$ to $7.5\times10^{-2}$ g/d and $8.0\times10^{-2}$ to $10.5\times10^{-2}$ g/d at temperature ranges of 100 to 140° C. and 230 to 240° C., respectively. These are thermal characteristics different from high strength and low shrinkage polyester yarns by the conventional direct spinning drawing process and warp drawing process.

FIG. 1 is a graph showing thermal-stress as a function of temperature for the high strength and low shrinkage polyester yarn according to example 1 of the present invention, and for two conventional types of polyester yarns.

With reference to FIG. 1, a high strength and low shrinkage polyester yarn (195ST) manufactured by ACODiS Co., LTD and another high strength and low shrinkage polyester yarn (HELS2) manufactured by KOLON INDUSTRIES, Inc. by the warp drawing process each have a single thermal-stress peak at a high temperature region. On the other hand, the high strength and low shrinkage polyester yarn (HS) of the present invention has two thermal-stress peaks, one at a low temperature and the other at a high temperature region. The reason for this is microstructural difference within the fiber resulting from different manufacturing process and thermal history. The high strength and low shrinkage polyester yarn by the warp drawing process has low thermal-stress at a low temperature because of low amorphous orientation, but the high strength and low shrinkage polyester yarn by the direct spinning drawing process has high thermal-stress at a low temperature because of much amorphous regions and a higher amorphous orientation than the fiber by the warp drawing process.

Figure 2:
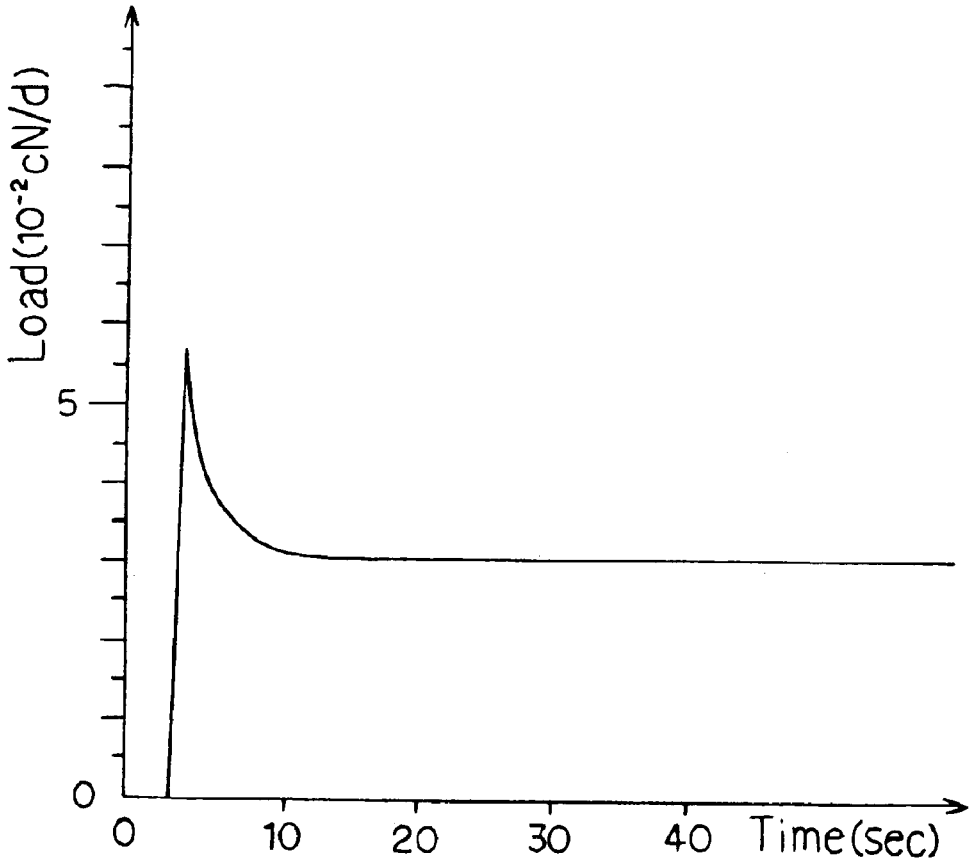
FIG. 2 is a graph showing load as a function of time for the high strength and low shrinkage polyester yarn by example 1 of the present invention, which illustrates a shrinkage behavior of the high strength and low shrinkage polyester yarn.

Meanwhile, the high strength and low shrinkage polyester yarn by the present invention is characterized in that a ratio of a thermal-stress peak at a temperature range of 230 to 240° C. to a thermal-stress peak at a temperature range of 100 to 140° C. is 1.3 to 3.0, and a shrinkage force of the polyester yarn within 5 sec after the onset of polyester yarn shrinkage is $4.5\times10^{-2}$ to $6.5\times10^{-2}$ cN/d and the shrinkage force of the polyester yarn after 5 sec is $1.5\times10^{-2}$ to $3.5\times10^{-2}$ cN/d, thereby securing excellent tenacity, shrinkage percentage, and elongation at break (refer to FIG. 2).

A better understanding of the present invention may be obtained in light of the following examples which are set forth to illustrate, but are not to be construed to limit the present invention.

EXAMPLE 1

Figure 3:
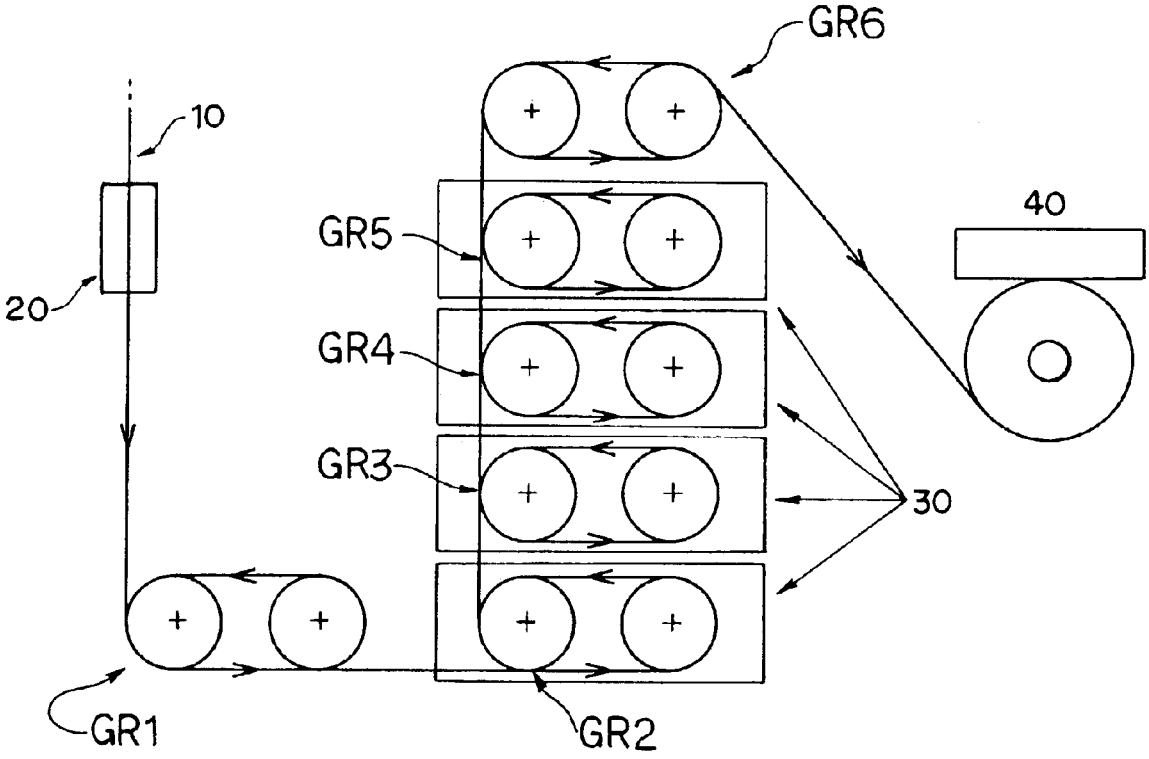
FIG. 3 is a flow diagram of a procedure of preparing the high strength and low shrinkage polyester yarn by the present invention.

Polyester chips with intrinsic viscosities of 0.84 produced by a solid state polymerization process were melted, spun through a spinning nozzle at a speed of 430 m/min, and cooled. A spun undrawn yarn 10 was passed through a device 20 for supplying oil and then drawn between a first roller GR1 and a fourth roller GR4 for a undrawn yarn. At this time, a speed of the fourth roller GR4 is adjusted to 2450 m/min so that a total draw ratio io is (refer to FIG. 3). Temperatures of the fourth roller GR4 and a fifth roller GR5 were all controlled to 240° C. to perform first and second heat-setting for the polyester yarn, and a first relaxation ratio between the fourth roller GR4 and fifth roller GR5 was controlled to 7% and second relaxation ratio between the fifth roller GR5 and a sixth roller GR6 was controlled to 3% so that total relaxation ratio was 10%. The second to fifth rollers GR2 to GR5 are positioned in a box 30 to keep insulated. A relaxed yarn was wound by a winding device 40 and the resulting polyester yarn was 1000 deniers in fineness.

EXAMPLES 2 TO 9 AND COMPARATIVE EXAMPLES 1 TO 7

The procedure of example 1 was repeated except that total draw ratio, temperatures of GR4 and GR5, relaxation ratio, and relaxation distribution ratio described in Table 2 were different from those of example 1. Physical properties of polyester yarns by examples 1 to 9 and comparative examples 1 to 7 were measured and the results are described in Tables 1 and 2.

In order to measure strength and elongation at break of a grey yarn, a sample of 250 mm was twisted in 80 turns/m addected to a tensile load with a test speed of 300 mm/min according to ASTM D885. Tenacity of the grey yarn was determined by dividing the measured strength of the grey yarn by weight of the grey yarn with a length of 9000 m.

Shrinkage percentage of the grey yarn was determined by measuring length difference of a sample before and after the sample was left at 190° C. for 15 min while being applied by a load of 0.01 g/d. Additionally, a shrinking force of the grey yarn was determined by measuring shrinkage of the sample for 1 min after the sample was nipped by being applied with a pre-tension of 0.01 g/d at 200° C.

A Kanebo Thermal Stress Tester (type KE-1) was used to observe continuous thermal-stress behavior, whereby the sample was formed into a loop, and drawn between two hooks to apply a pre-tension of 0.05 g/d (100 g in case of 1000 d, or 50 g in case of 500 d), and heated from a room temperature to 300° C. at a rate of 200° C./min.

Workability was determined by measuring the generation of fluff using a fluff counter manufactured by Daiko Co. of Japan, positioned beforefore a .Ung machine. Based on 10 kg of the wound sample, if a measured value is 3 or lower, workability is considered to be excellent, and if the value is 4 or higher, workability is considered to be normal.

The draw ratio, relaxation ratio, and relaxation distribution ratio are defined as follows:

Draw ratio rotation speed of *GR*4/rotation speed of *GR*1

Relaxation ratio=first relaxation ratio+second relaxation ratio.

First relaxation ratio={(rotation speed of *GR*4−rotation speed of *GR*5)/rotating speed of *GR*4}×100

Second relaxation ratio={(rotation speed of *GR*5−rotation speed of *GR*6)/rotation speed of *GR*5}×100

Relaxation Distribution ratio=first relaxation ratio/second relaxation ratio

TABLE 1

| Examples | 1 | 2 | 3 | 4 | 5 | 6 | 7 | 8 | 9 |
|---|---|---|---|---|---|---|---|---|---|
| [1]Total D.R. | 5.7 | 6.0 | 6.2 | 6.4 | 5.5 | 6.2 | 6.4 | 6.0 | 6.2 |
| [2]T. of GR4/5 | 240/240 | 250/250 | 250/250 | 240/180 | 240/240 | 230/230 | 250/250 | 244/190 | 244/244 |
| [3]Relaxation | 10 | 12 | 12 | 13 | 9 | 13 | 13 | 11 | 11.5 |
| [4]Distribution | 7:3 | 9:1 | 6:4 | 10:0 | 8:2 | 1:9 | 9:1 | 10:0 | 7:3 |
| [5]Tenacity | 7.8 | 8.1 | 8.4 | 8.5 | 7.4 | 8.2 | 8.4 | 7.5 | 8.2 |
| [6]Break. | 24.5 | 23.2 | 23.8 | 22.5 | 25.4 | 24.2 | 19.7 | 23.2 | 23.5 |
| [7]Shrinkage | 1.4 | 1.5 | 1.3 | 1.7 | 1.5 | 1.7 | 1.3 | 1.7 | 1.1 |
| [8]Max. shr. | 5.8 | 5.7 | 4.8 | 6.1 | 5.9 | 6.2 | 4.7 | 6.3 | 4.5 |
| [9]Final shr. | 3.1 | 3.1 | 2.0 | 3.3 | 3.1 | 3.2 | 1.9 | 3.3 | 1.8 |
| [10]Peak | 110/231 | 110/234 | 105/232 | 130/230 | 140/235 | 102/236 | 118/231 | 123/233 | 128/235 |
| [11]Thermal-stress | 4.7/9.2 | 5.3/9.1 | 4.5/8.8 | 7.2/10.1 | 5.2/9.0 | 7.4/9.6 | 4.3/9.0 | 7.4/10.2 | 3.1/9.5 |
| Workability | Excel. | Excel. | Excel. | Excel. | Excel. | Excel. | Excel. | Excel. | Excel. |

[1]Total D.R.: Total draw ratio
[2]T. of GR4/5: temperatures of GR4/5 (° C.)
[3]Relaxation: relaxation ratio (%)
[4]Distribution: distribution ratio
[5]Tenacity: tenacity (g/d)
[6]Break.: elongation at break(%)
[7]Shrinkage: shrinkage percentage (%)
[8]Max. shr.: maximum shrinkage force ($\times 10^{-2}$ cN/d)
[9]Final shr.: final shrinkage force ($\times 10^{-2}$ cN/d)
[10]Peak: thermal-stress peak temperature (° C.)
[11]Thermal-stress: thermal-stress ($\times 10^{-2}$ g/d)
Excel.: excellent

TABLE 2

| Comp. Examp. | 1 | 2 | 3 | 4 | 5 | 6 | 7 |
|---|---|---|---|---|---|---|---|
| [1]Total D.R. | 4.0 | 7.0 | 6.0 | 5.7 | 6.0 | 5.9 | 6.2 |
| [2]T. of GR4/5 | 230/230 | 230/230 | 240/180 | 240/190 | 255/190 | 220/220 | 220/220 |

TABLE 2-continued

| Comp. Examp. | 1 | 2 | 3 | 4 | 5 | 6 | 7 |
|---|---|---|---|---|---|---|---|
| [3]Relaxation | 9 | 9 | 14 | 8 | 13 | 9 | 10 |
| [4]Distribution | 7:3 | 8:2 | 10:0 | 10:0 | 10:0 | 8:2 | 2:8 |
| [5]Tenacity | 6.5 | — | 7.2 | 7.5 | 7.3 | 7.5 | 7.9 |
| [6]Break. | 26.7 | — | 23.6 | 24.7 | 23.8 | 23.1 | 22.5 |
| [7]Shrinkage | 1.4 | — | 1.8 | 2.2 | 1.8 | 5.3 | 5.5 |
| [8]Max. shr. | 6.5 | — | 6.5 | 7.1 | 7.2 | 7.4 | 7.8 |
| [9]Final shr. | 5.0 | — | 5.1 | 6.0 | 6.2 | 4.2 | 4.5 |
| [10]Peak | 125/232 | — | 112/232 | 128/235 | 105/230 | 123/232 | 124/237 |
| [11]Thermal-stress | 4.5/9.4 | — | 6.5/9.8 | 8.2/10.3 | 6.2/9.5 | 10.3/11.2 | 10.5/11.5 |
| Workability | Excel. | Breakage | Normal | Excel. | Normal | Excel. | Excel. |

[1]Total D.R.: Total draw ratio
[2]T. of GR4/5: temperatures of GR4/5 (° C.)
[3]Relaxation: relaxation ratio (%)
[4]Distribution: distribution ratio
[5]Tenacity: tenacity (g/d)
[6]Break.: elongation at break (%)
[7]Shrinkage: shrinkage percentage (%)
[8]Max. shr.: maximum shrinkage force ($\times 10^{-2}$ cN/d)
[9]Final shr.: final shrinkage force ($\times 10^{-2}$ cN/d)
[10]Peak: thermal-stress peak temperature (° C.)
[11]Thermal-stress: thermal-stress ($\times 10^{-2}$ g/d)
Excel.: excellent
Breakage: yarn breakage From the results of Table 1, it can be seen that the polyester yarn of the present invention (examples 1 to 9) having thermal-stress peaks of $3\times10^{-2}$ to $7.5\times10^{-2}$ g/d and $8.0\times10^{-2}$ to $10.5\times10^{-2}$ g/d at temperature ranges of 100 to 140° C. and 230 to 240° C., respectively, has excellent tenacity and shrinkage property, thus desirably reducing yarn breakage, monofilament yarn breakage, and tar occurrence on the roller, thereby improving workability. The reason for this is that a total draw ratio, a relaxation temperature, a relaxation ratio, and a relaxation distribution ratio are desirably controlled.

Meanwhile, in the case of comparative example 1, workability is excellent but the total draw ratio is too low to secure desirable physical properties, and in the case of comparative example 2, the total draw ratio is too high, thus causing yarn breakage. The yarn according to comparative example 3 has excessively high relaxation ratio, so it is difficult to secure desirable workability due to severe trembling of threads on the godet roller.

Furthermore, the yarn by comparative example 4 does not obtain shrinkage of 2% or lower when the relaxation ratio is 8%. Additionally, the yarn by comparative example 5 has low shrinkage property at the relaxation ratio of 13%, but has too low yarn tenacity because of a high temperature of the godet roller and has disadvantages of yarn breakage due to contamination of the godet roller. In the case of comparative examples 6 and 7, the shrinkage percentage is undesirably 2% or higher because a temperature of the relaxation region is not sufficiently high.

As described above, a high strength and low shrinkage polyester yarn by the present invention is advantageous in that it has excellent physical properties such as tenacity of 7.4 g/d or higher, elongation at break of 19 to 26%, and shrinkage percentage of 2% or lower, thus securing sufficient resistance to external load and excellent dimensional stability with uniform shrinkage during a post-process. Therefore, the polyester yarn according to the present invention is very useful as an industrial yarn such as tarpaulin and truck covers.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A high strength and low shrinkage polyester yarn, which has tenacity of 7.4 g/d or higher, elongation at break of 19 to 26%, shrinkage percentage of 2% or lower, and respective thermal-stress peaks of $3\times10^{-2}$ to $7.5\times10^{-2}$ g/d and $8.0\times10^{-2}$ to $10.5\times10^{-2}$ g/d at temperature ranges of 100 to 140° C. and 230 to 240° C.

2. The high strength and low shrinkage polyester yarn as set forth in claim 1, wherein a ratio of a yarns's thermal-stress peak at a temperature range of 230 to 240° C. to a thermal-stress peak at a temperature range of 100 to 140° C. is 1.3 to 3.0.

3. The high strength and low shrinkage polyester yarn as set forth in claim 1, wherein a shrinkage force of the polyester yarn within a first 5 sec after the start of shrinkage is $4.5\times10^{-2}$ to $6.5\times10^{-2}$ cN/d, and the shrinkage force of the polyester yarn thereafter is $1.5\times10^{-2}$ to $3.5\times10^{-2}$ cN/d.

* * * * *